US008037973B2

(12) United States Patent
Lin

(10) Patent No.: US 8,037,973 B2
(45) Date of Patent: Oct. 18, 2011

(54) FIXING DEVICE FOR ANTI-SLIP CABLE LOCK

(76) Inventor: Ruei-Hsing Lin, Taipei Hsien (TW)

( * ) Notice: Subject to any disclaimer, the term of this patent is extended or adjusted under 35 U.S.C. 154(b) by 693 days.

(21) Appl. No.: 12/136,079

(22) Filed: Jun. 10, 2008

(65) Prior Publication Data

US 2009/0301823 A1 Dec. 10, 2009

(51) Int. Cl.
*B65H 59/16* (2006.01)

(52) U.S. Cl. ..... 188/65.1; 188/68; 188/69; 188/82.1; 188/265

(58) Field of Classification Search ..... 188/65.1–65.5, 188/68, 69, 82.1, 265, 83, 84; 24/136 A, 24/136 L, 136 B, 115 F, 115 L
See application file for complete search history.

(56) References Cited

U.S. PATENT DOCUMENTS

| | | | | |
|---|---|---|---|---|
| 2,905,274 | A * | 9/1959 | Cook | 188/65.1 |
| 2,994,563 | A * | 8/1961 | Ruggiero | 303/2 |
| 4,141,117 | A * | 2/1979 | Van Gompel | 24/136 R |
| 4,549,709 | A * | 10/1985 | Deligny | 248/56 |
| 6,412,606 | B1 * | 7/2002 | Wu | 188/68 |

* cited by examiner

*Primary Examiner* — Xuan Lan Nguyen

(57) ABSTRACT

A fixing device for an anti-slip cable locker is disclosed. The fixing device provides a connection such that after the cable is engaged, and a single screw action, the cable can be locked after engagement, and therefore, article hooked to the locker will be securedly locked. The fixing device allows a quick installation, rapid engagement with the cable locker and provides anti-slip from the cable locker.

1 Claim, 6 Drawing Sheets

FIXING DEVICE FOR ANTI-SLIP CABLE LOCK

BACKGROUND OF THE INVENTION (a) Technical Field of the Invention

The present invention relates to a fixing device for an anti-slip cable locker, and in particular, a fixing device which can rapidly install, position a cable locker in a secured position.

(b) Description of the Prior Art

FIG. 1 is a conventional cable fixing device A1 employing a tension spring A13, auxiliary steel beads A15 to urge a cable A2 to be locked. At normal situation, the steel beads A15 urge by the elastic spring A13 to form a constantly engaged state. The structure of the conventional fixing device A1 comprises a front nut cap A11, a fixing device body A12, a tension spring A13, a displacement axle core A14 and steel balls A15 provided to the displacement axle core A14. The front nut cap A11 is connected to the fixing device body A12, and the inner edge of the front nut cap A11 is a tapered converging wall A111 corresponding to the converging face A141 of the displacement axle core A14 and the steel beads A15, which can be fully controlled within the fixing device body A12.

Thus, the front nut cap A11, the steel beads A15 and the displacement axle core A14, together with the tension spring A13, and the displacement of the axle core A14, the steel beads A15 achieves the effect of fastening or releasing the cable A2.

However, the conventional fixing device A1 has the drawback that the device can be used for engagement but it does not provide a locking or fixing effect. If the tension of the spring A13 is insufficient or the displacement axle core A14 is retreated, the suspended article will fall down.

SUMMARY OF THE INVENTION

The primary purpose of the present invention is to provide a fixing device for anti-slip cable lock comprising a braking device and a locking device linked to each other, wherein the braking device comprises a front nut cap, a tension spring, a displacement axle core, a braking body and steel ball module mounted onto the displacement axle core, wherein the front nut cap is connected to the braking body and has a through hole and an edge section on the front direction of the cap, the through hole allowing a suspension cable to pass through and the edge section used to against the tension spring mounted internally, wherein the tension spring is positioned within the braking body, and employs the edge section of the front nut cap to exert a force on the displacement axle core; wherein the displacement axle core is positioned within the braking body and the front end of the displacement axle core is restricted by the force exerted by the tension spring, the front section position of the axle core is provided with a holding hole for holding the steel ball module, each holding hole and the number of steel beads provided to the hole has a specific tolerance with the inner edge wall of the braking body and the front nut cap inner diameter such that each of the steel beads has a tolerance in the holding hole but is restricted from dislocation, and each of the axle core is hollow which allows a suspension cable to pass through, the rear direction section is a screw end protruded out of the end opening of the braking body and directly mounted to the locking device, further the screw end has a tapered blocking edge; wherein the braking body has a front direction mounted with a front nut cap, and the inner edge wall of the braking body is a convergence face to correspond with the displacement axle core and the provided steel ball module, the rear direction of the braking body is a rear end opening; wherein the steel bead module is positioned at the holding hole corresponding to the displacement axle core and is provided with specific tolerance with the gradually convergence face and the inner diameter of the front cap nut, wherein the locking device is a screw element and is linked to the braking device, the interior of the locking device is provided with screw threads for the screw end of the displacement axle core, and a provided limiting hole restricts at the tapered blocking edge of the displacement axle core screw end opening.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 2:
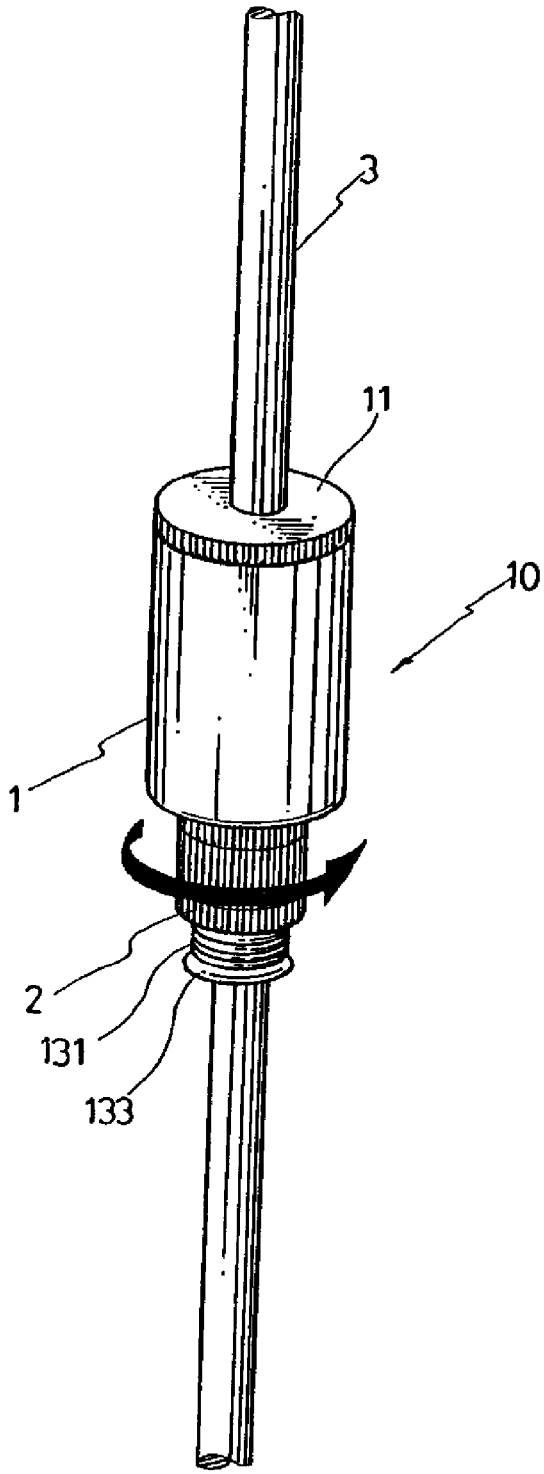
FIG. 2 is a perspective view of a preferred embodiment of the present invention (locking mode)
Figure 3:
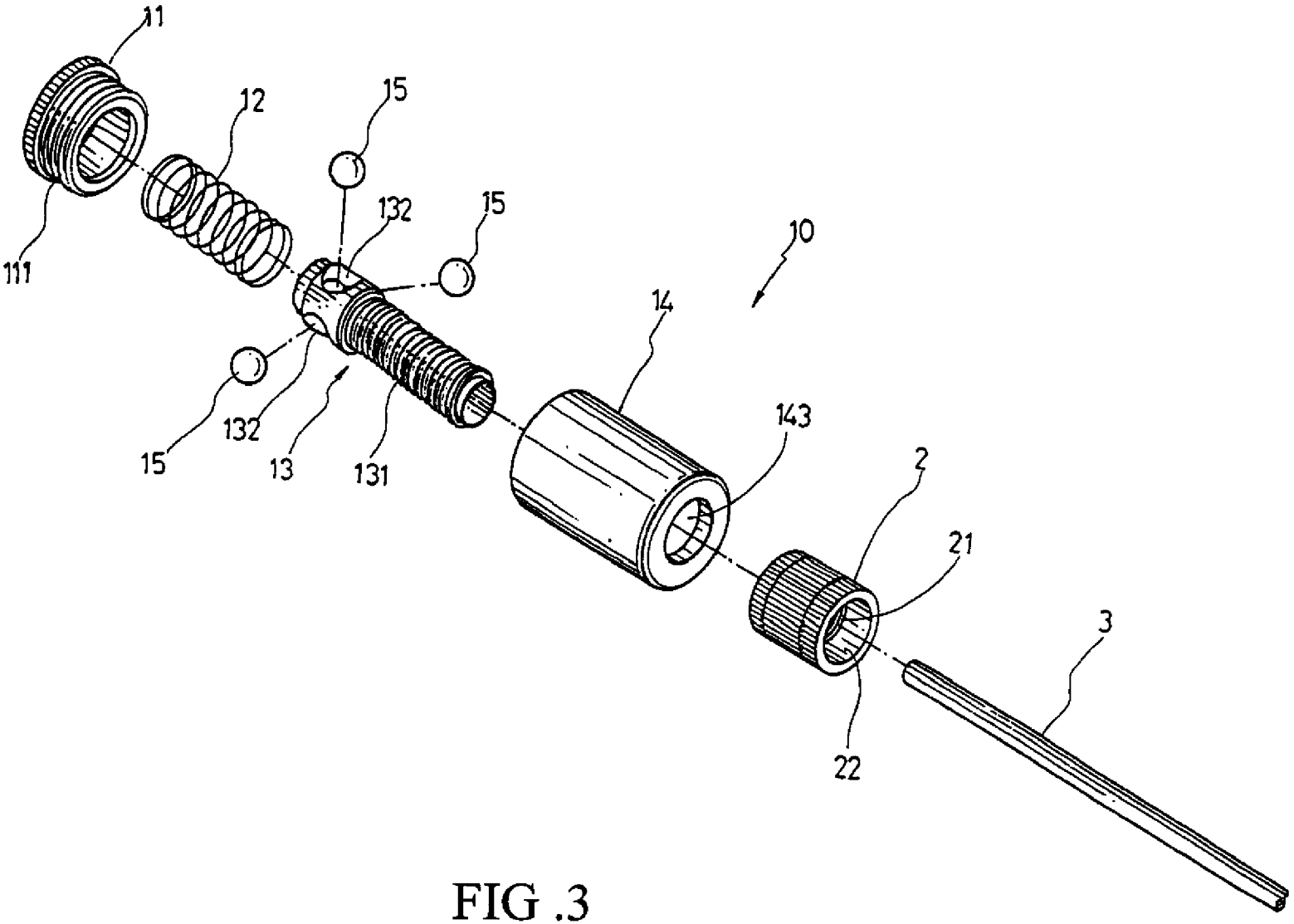
FIG. 3 is an exploded perspective view of individual components of the present invention.

Referring to FIGS. 2 and 3, there is shown a fixing device for anti-slip cable locker 10 comprising a braking device 1 and a locking device 2, and the braking device 1 and the locking device 2 are constantly connected to form into a complete fixing device 10. The braking device 1 comprises a front nut cap 11, a tension spring 12, a displacement axle core 13, a braking body 14 and the steel balls 15 arranged on the displacement axle core 13. The locking device 2 is formed with internal threads and it is connected to or inseparable from the braking device 1.

Figure 4:
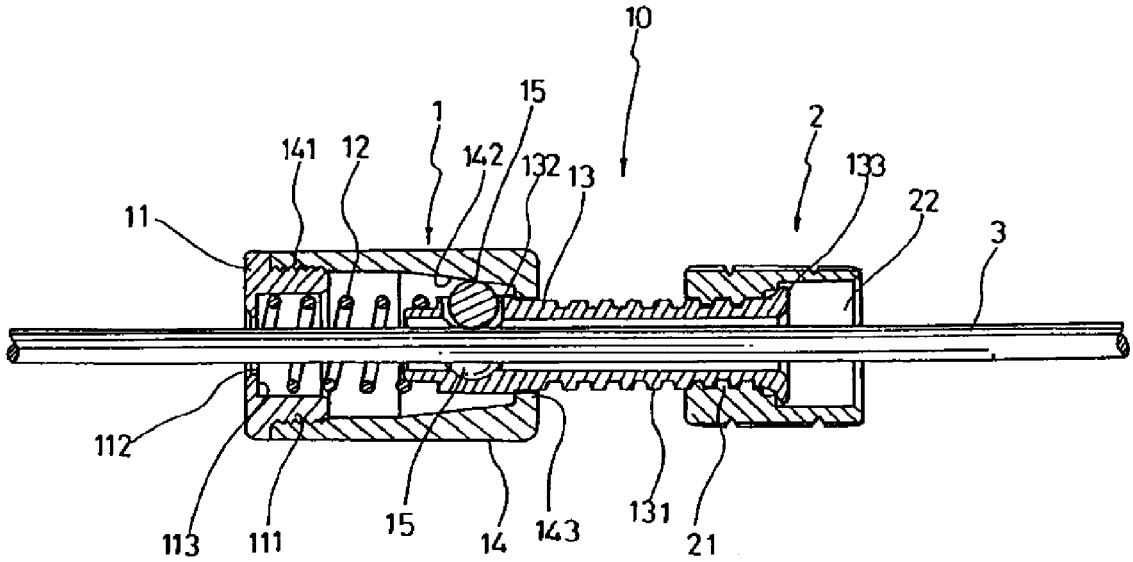
FIG. 4 is a sectional view of the present invention (in engagement mode).

Referring to FIG. 4, the front nut cap 11 uses external threads 111 to connect to internal threads 141 of the braking body 14, and the front nut cap 11 is provided with a through hole 112 and a seat 113, the through hole 112 allows a cable 3 to pass through and the seat 113 is used to resist the tension spring 12 such that the spring 12 is constantly urging the displacement axle core 13 so that the steel balls 15 are at a state of urging. The front section of the braking body 14 is engaged with the front nut cap 11, and the inner edge wall has a converging face 142 so as to correspond to the displacement axle core 13 and the steel balls 15, and the rear end opening 143 allows the threaded portion of the displacement axle core 13 to pass through so as to connect the locking device 2. Further, the displacement axle core 13 is positioned within the braking body 14 and the front end is restricted by the tension of the tension spring 12, and the rear section is provided with holding holes 132 to hold the steel balls 15. Each holding hole 13 and the given steel balls 15 form a tolerance with the inner edge of the body and the inner diameter of the front nut cap, such that each steel ball 15 can be held within the holding hole 132 with a tolerance but the steel balls 15 are restricted from dislocation.

As shown in FIG. 4, the displacement axle core 13 is hollow, allowing a cable 3 to pass through, each holding hole 132 has a steel ball 15 corresponding to the converging face 142 of the inner edge of the braking body, an engagement is formed. The rear section of the displacement axle core 13 has a threaded portion 131 which passes out from the rear end opening 143, and is directly screwed to the locking device 2. The substantial structure is that the end of the threaded portion 131 is formed into a blocking edge 133, i.e., it forms with the locking device 2 to form an anti-slip connection. The locking device 2 has a screw body which is provided with internal threads 21 which are engaged with the threaded portion 131 of the displacement axle core 13. The limiting hole 22 restricts the blocking edge 133 such that the threaded portion 131 of the displacement axle core 13 will not dislocate from the locking device 2.

Figure 1:
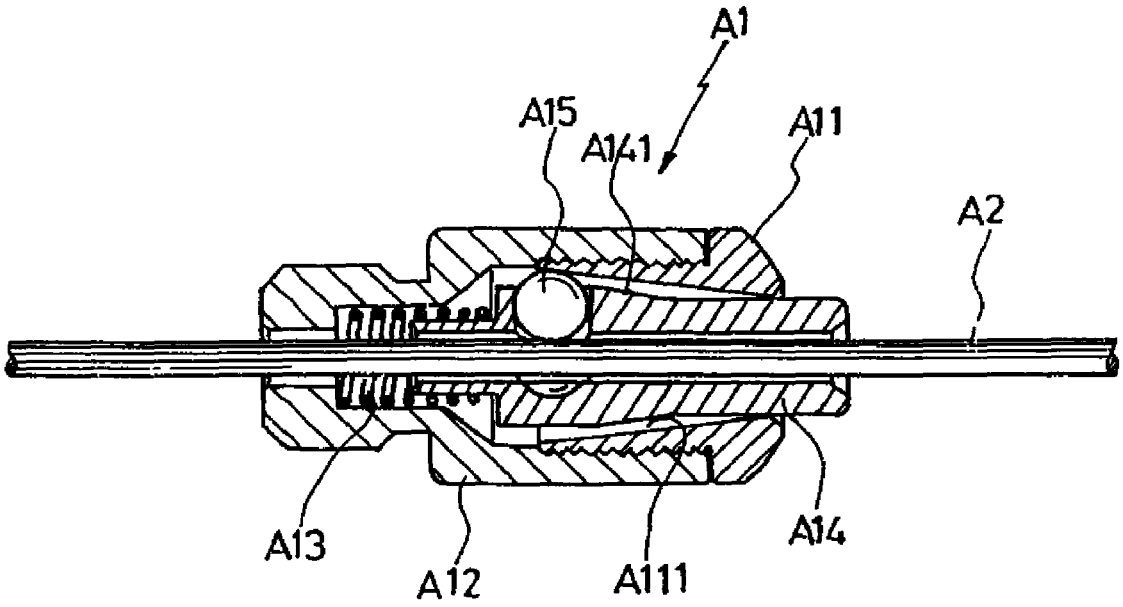
FIG .1 PRIOR ART
FIG. 1 is a sectional view of a conventional fixing device
Figure 6:
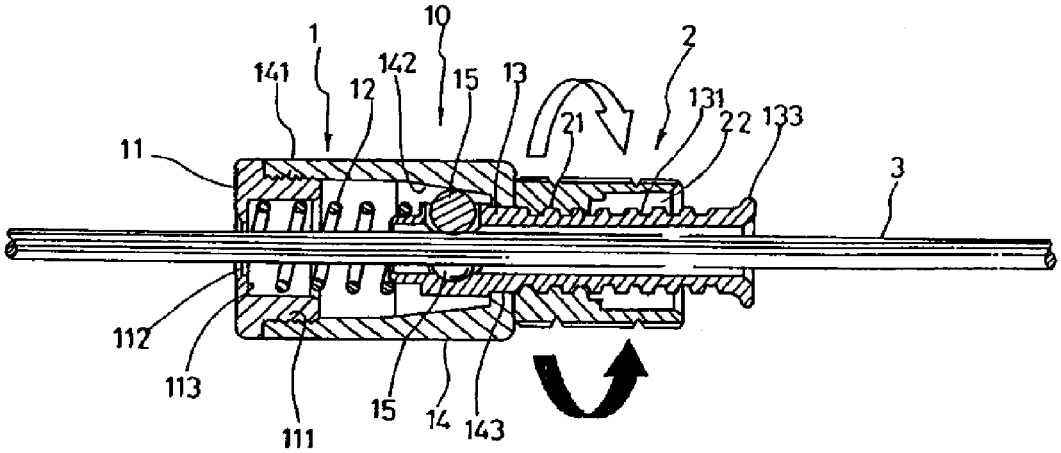
FIG. 6 is a sectional view indicating a second schematic operation in accordance with the present invention (engagement and locking state).

Referring to FIG. 4 again, when the braking device is at normal condition, the tension spring 12 urges a tension force to push the displacement axle core 13. At this point of time, the steel balls 15 correspond to the converging face 142, each of the steel balls 15 will urge to the cable 3. Thus, fastening or engaging effect is formed. At this point of time, when the locking device 2 and the displacement axle core 13 are connected, a locking is formed between the locking device 2 and the braking body 14, which means an addition locking force is provided in accordance with the present invention. This equals to provide the displacement axle core 13 a strong pulling force, which is converted into a strong engagement force to ensure the fastening strength of the braking device 1. This will fully prevent the inner push of the displacement axle core 13, as shown in FIGS. 1 and 6.

Figure 5:
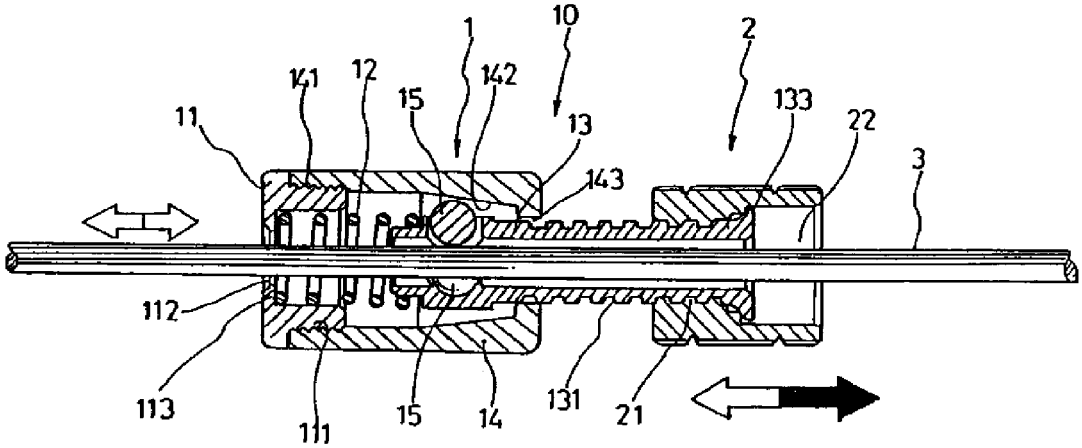
FIG. 5 is a sectional view showing the operation thereof of the present invention (releasing mode).
Figure 7:
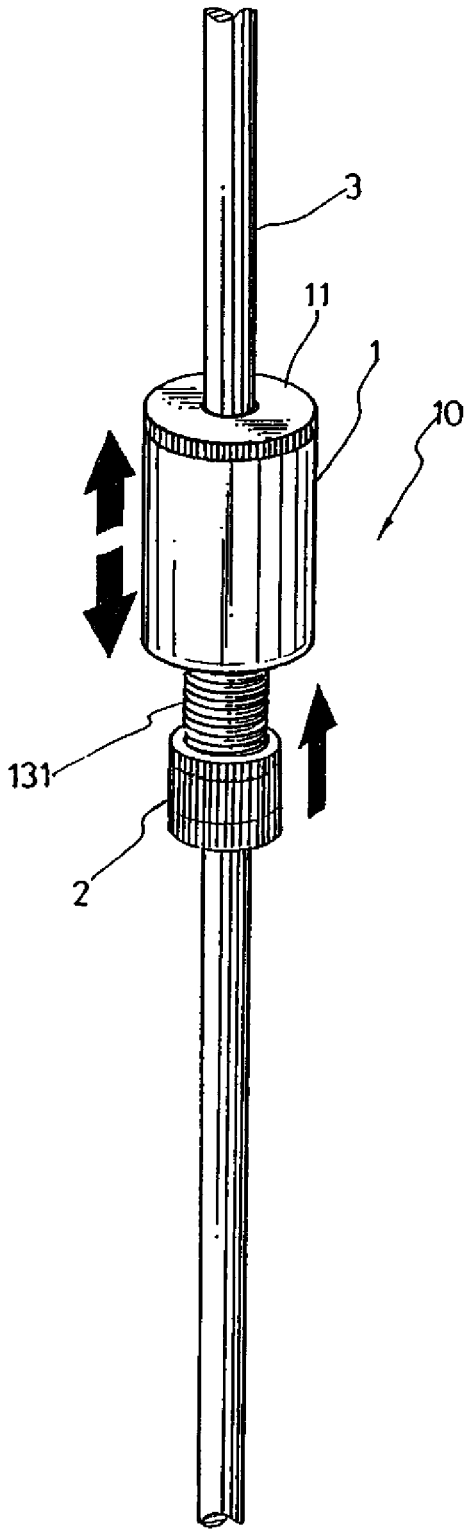
FIG. 7 is a perspective view of the present invention.

Referring to FIGS. 5 and 7, when the braking device 1 is released, the locking device 2 is unscrewed and pushed to the linked displacement axle core 13, the steel balls 15 on the axle core 13 will form a releasing gap with the converging face 142, and at this point of time, the cable 3 is released and the entire fixing device 10 achieves the required adjustments effect.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A fixing device for anti-slip cable lock comprising:

a braking device comprising:

a braking body which is a hollow member having a first end provided with internal threads and a second end provided with a through hole, said braking body having an inner inclined wall surface which converges towards said second end;

a front nut cap provided with external threads engaged with said internal threads of said braking body, said front nut cap having a recess which has a seat provided with a through hole a displacement axle core which is hollow and has a threaded portion and an end adjacent to said threaded portion, said end of said displacement axle core having a plurality of holding holes, said end of said displacement axle core being fitted into said second end of said braking body through said through hole of said braking body, said threaded portion having another end provided with a blocking edge;

a plurality of steel balls each fitted in a respective one of said holding holes of displacement axle core; and a tension spring having a first end and a second end, said first end of said tension spring being received in said recess of said front nut cap and bearing against said seat of said front nut cap, said second end of said tension spring bearing against said end of said displacement axle core;

a locking device having a hollow body provided with internal threads which are engaged with said threaded portion of said displacement axle core, said hollow body having a limiting hole restricting said blocking edge of said displacement axle core; and a cable extending through said front nut cap, said braking body, said displacement axle core and said locking device;

wherein when said braking device is at normal condition, said tension spring urges against said displacement axle core thereby causing said inner inclined wall surface of said braking body to push said steel balls against said cable thereby fixing said cable in position; when said locking device is turned to bear against said second end of said braking body, an additional locking force is provided to said cable; when desired to release said cable, said locking device is turned away from said braking body and said displacement axle core is pushed inside said braking body thereby releasing said steel balls from said inner inclined wall surface.

* * * * *